US006091051A

United States Patent [19]

Morigami et al.

[11] Patent Number: 6,091,051

[45] Date of Patent: Jul. 18, 2000

[54] HEATING DEVICE

[75] Inventors: Yuusuke Morigami; Toshio Sakata, both of Toyohashi; Eiji Okabayashi; Yoshifumi Kosagi, both of Toyokawa, all of Japan

[73] Assignee: Minolta Co., Ltd., Osaka, Japan

[21] Appl. No.: 08/997,313

[22] Filed: Dec. 23, 1997

[30] Foreign Application Priority Data

| | | | |
|---|---|---|---|
| Dec. 28, 1996 | [JP] | Japan | 8-358449 |
| Dec. 28, 1996 | [JP] | Japan | 8-358454 |
| Oct. 14, 1997 | [JP] | Japan | 9-280339 |
| Oct. 22, 1997 | [JP] | Japan | 9-290029 |

[51] Int. Cl.[7] ..... G03G 15/20; H01R 39/20; H01R 39/18

[52] U.S. Cl. ..... 219/216; 399/331; 310/251

[58] Field of Search ..... 219/216, 469–471; 310/233, 236, 251–253; 399/330–334; 432/60, 228; 492/46; 118/60

[56] References Cited

U.S. PATENT DOCUMENTS

| | | | |
|---|---|---|---|
| 3,601,645 | 8/1971 | Whiteheart | 310/251 |
| 3,617,785 | 11/1971 | Kristiansen | 310/236 |
| 4,084,669 | 4/1978 | Suwa et al. | 310/251 |
| 4,101,453 | 7/1978 | Orford et al. | 310/252 |
| 4,349,384 | 9/1982 | Weinert | 310/233 |
| 4,358,319 | 11/1982 | Yoshida et al. | 310/233 |
| 4,745,431 | 5/1988 | Kogure et al. | 399/69 |
| 5,701,046 | 12/1997 | Kammerer et al. | 310/251 |

*Primary Examiner*—Joseph Pelham
*Attorney, Agent, or Firm*—McDermott, Will & Emery

[57] ABSTRACT

A heating device comprises an endless rotary member, a resistance heating member, a current receiver member provided at the endless rotary member and a current supply member being in contact with the current receiver member.

In a form, the current supply member is made of a sintered material containing copper and carbon, and a content of the copper in the sintered material is in a range from 55% to 80% by weight.

In another form, a contact surface of the current receiver member is formed of a material harder than the current supply member. The contact surface of the current receiver member and the contact surface of the current supply member have surface roughnesses satisfying a relationship of (surface roughness of the current receiver member)≦(surface roughness of the current supply member). The surface roughness Ra of the current receiver member is in a range from 0.3 $\mu$m to 5.5 $\mu$m. The surface roughness Ra of the current supply member is equal to or smaller than 5.5 $\mu$m.

8 Claims, 9 Drawing Sheets

HEATING DEVICE

BACKGROUND OF THE INVENTION

1. Field of the Invention

The present invention relates to a heating device which can be utilized for heating an unfixed image in a fixing device which is arranged in an electrophotographic image forming apparatus such as a copying machine, printer or the like, and fixes the unfixed image such as a toner image onto a record member bearing the unfixed image.

2. Description of Related Art

A fixing device in an image forming apparatus such as a printer or a copying machine generally includes a heating device provided with a heating roller. A record member bearing an unfixed image such as a toner image is moved between the heating roller and a backup member (generally, a pressure roller) opposed thereto, so that the unfixed image is heated and pressed to be fixed onto the record member.

In many cases, the heating roller includes a heater such as a halogen lamp heater, and the roller is heated by heat radiated from the heater.

In the heating device including the heating roller which contains the heater such as a halogen lamp heater as a heat source, however, the heater cannot rapidly heat a surface of the heating roller to a predetermined fixing temperature after start of power supply to the heater so that a long preheating time (i.e., a warming-up time) is required before the heating roller reaches the predetermined temperature after power-on of the image forming apparatus. This prevents easy operation of the apparatus.

For reducing the preheating time, a heating roller has been proposed. This roller includes a core roller and a resistance heating member formed on the core roller. The resistance heating member is made of a substance which generates heat when an electric current flows therethrough. The heating roller of this type has a good electrothermal converting efficiency, and can rapidly raise the surface temperature of the heating roller to the predetermined temperature after start of current supply to the resistance heating member so that the preheating time of the heating roller can be reduced.

For supplying a current to the resistance heating member, the heating device having the heating roller of the above type is generally provided with a current receiver member which is electrically connected to the resistance heating member and rotates together with the heating roller, and a current supply member which is in contact with the current receiver member. The resistance heating member is supplied with the current through these supply and receiver members. When the heating roller rotates, the current receiver member also rotates together with the heating roller, and slides on the current supply member.

In the heating device in which the current is supplied to the resistance heating member through the supply and receiver members in sliding contact with each other, when an electrical contact resistance at the mutual contact surfaces of the supply and receiver members increases, a large voltage drop occurs at the mutual contact surfaces, and a voltage across the opposite ends of the resistance heating member lowers. The contact resistance at the mutual contact surfaces increases if the surface roughness(es) at the mutual contact surface(s) of the supply and/or receiver members are large and therefore the area of the mutual contact region between these members is small.

In view of the above, such a structure has been proposed that one of the current supply member and the current receiver member is made of a material containing carbon (carbon material) such as material containing carbon and copper (carbon material containing copper), and the other is made of metal or the like harder than the carbon material. Usually, the current supply member is made of the carbon material in view of maintainability. If the current supply member is made of carbon material, a carbon film or layer is formed at the surface of the current receiver member when the current receiver member slides on the current supply member in accordance with rotation of the heating roller. This carbon film smoothens the mutual contact surfaces of the supply and receiver members, which reduces the electrical contact resistance at the mutual contact surfaces. Accordingly, the current can be supplied more stably to the resistance heating member through the supply and receiver members.

The carbon film is formed as a result of shaving of the current supply member made of carbon material due to sliding between the supply and receiver members. The shaving of the current supply member is affected by the surface roughnesses of the contact surfaces of the current supply member and current receiver member as well as the difference between these surface roughnesses. However, the conventional heating devices have been designed without particularly taking the above fact into consideration.

If the current supply member is made of a carbon material containing copper as described above, the content of copper affects the electrical contact resistance at the mutual contact surfaces of the receiver and supply members as well as a specific resistance of the current supply member itself. Depending on the content of copper, therefore, the voltage across the opposite ends of the resistance heating member may excessively lower, and the time required for temperature rising (the preheating time) of the heating roller may excessively increase. Further, the content of copper in the carbon current supply member affects the sliding property at the mutual contact surfaces of the receiver and supply members as well as thicknesses or quantities of wear of the supply and receiver members.

In the prior art, however, the content of copper in the current supply member made of carbon material containing copper is not particularly taken into consideration.

The following problem also arise when the current supply member made of carbon material is employed. In an early stage before the carbon film is sufficiently formed at the contact surface of the current receiver member in contact with the current supply member as a result of sliding between the supply and receiver members, the electrical contact resistance at the mutual contact surfaces of the supply and receiver members changes significantly and therefore the voltage cannot be stably supplied to the resistance heating member. In other words, the above problem occurs in such an early stage that the carbon film is growing on the surface of the current receiver member not covered with the carbon film.

SUMMARY OF THE INVENTION

An object of the invention is to provide a heating device which can be utilized in a fixing device for heating and fixing an unfixed image onto a record member bearing the unfixed image, and includes a current receiver member rotating together with an endless rotary member such as a roller and a current supply member in contact with the current receiver member for supplying an electric power to a resistance heating member provided at the endless rotary member, and particularly is to provide the heating device which can stably supply the electric power to the resistance heating member.

Another object of the invention is to provide a heating device, in which an electrical contact resistance at mutual contact surfaces of the current supply member and the current receiver member is reduced so that a voltage drop at the mutual contact surfaces is reduced, and therefore a voltage can be stably applied to the resistance heating member.

Still another object of the invention is to provide a heating device, in which a specific resistance of the current supply member is reduced so that a voltage drop at the current supply member is reduced, and therefore a voltage can be stably applied to the resistance heating member.

Yet another object of the invention is to provide a heating device, in which an electrical contact resistance at mutual contact surfaces of the current supply member and the current receiver member is small even at the start of use of the device so that a voltage can be stably supplied to a resistance heating member even at the start of use of the device.

A further object of the invention is to provide a heating device, in which abrasive wear of a contact surface of the current supply member in contact with the current receiver member is suppressed so that the current supply member can have a long lifetime, and therefore stable supply of an electric power to the resistance heating member can be performed for a long term.

The invention provides the following three types, i.e., first, second and third types of heating devices.

The heating device of the first type comprises an endless rotary member having a peripheral surface to be moved rotatively; a resistance heating member arranged at the peripheral surface of the endless rotary member and generating a heat when supplied with an electric current; a current receiver member provided at the endless rotary member and electrically connected to the resistance heating member; and a current supply member being in contact with the current receiver member and to be electrically connected to a power source. In the heating device of the first type, the current supply member is made of a sintered material containing copper and carbon, and a content of the copper in the sintered material is in a range from 55% to 80% by weight.

The heating device of the second type comprises an endless rotary member having a peripheral surface to be moved rotatively; a resistance heating member arranged at the peripheral surface of the endless rotary member and generating a heat when supplied with an electric current; a current receiver member provided at the endless rotary member and electrically connected to the resistance heating member; and a current supply member being in contact with the current receiver member and to be electrically connected to a power source. In the heating device of the second type, the current supply member is made of a sintered material containing copper and carbon, a content of the copper in the sintered material is in a range from 55% to 80% by weight, and a carbon film is formed at a contact surface of the current receiver member for contact with the current supply member.

The heating device of the third type comprises an endless rotary member having a peripheral surface to be moved rotatively; a resistance heating member arranged at the peripheral surface of the endless rotary member and generating a heat when supplied with an electric current; a current receiver member provided at the endless rotary member and electrically connected to the resistance heating member; and a current supply member being in contact with the current receiver member and to be electrically connected to a power source. In the heating device of the third type, a contact surface of the current receiver member for contact with the current supply member is formed of a material harder than a contact surface of the current supply member for contact with the current receiver member. The contact surface of the current receiver member for contact with the current supply member and the contact surface of the current supply member for contact with the current receiver member have surface roughnesses satisfying a relationship of (surface roughness of the current receiver member) $\leqq$ (surface roughness of the current supply member). The surface roughness Ra of the current receiver member is in a range from 0.3 $\mu$m to 5.5 $\mu$m. The surface roughness Ra of the current supply member is equal to or smaller than 5.5 $\mu$m.

The foregoing and other objects, features, aspects and advantages of the present invention will become more apparent from the following detailed description and the accompanying drawings.

DESCRIPTION OF THE PREFERRED EMBODIMENTS

Figure 1:
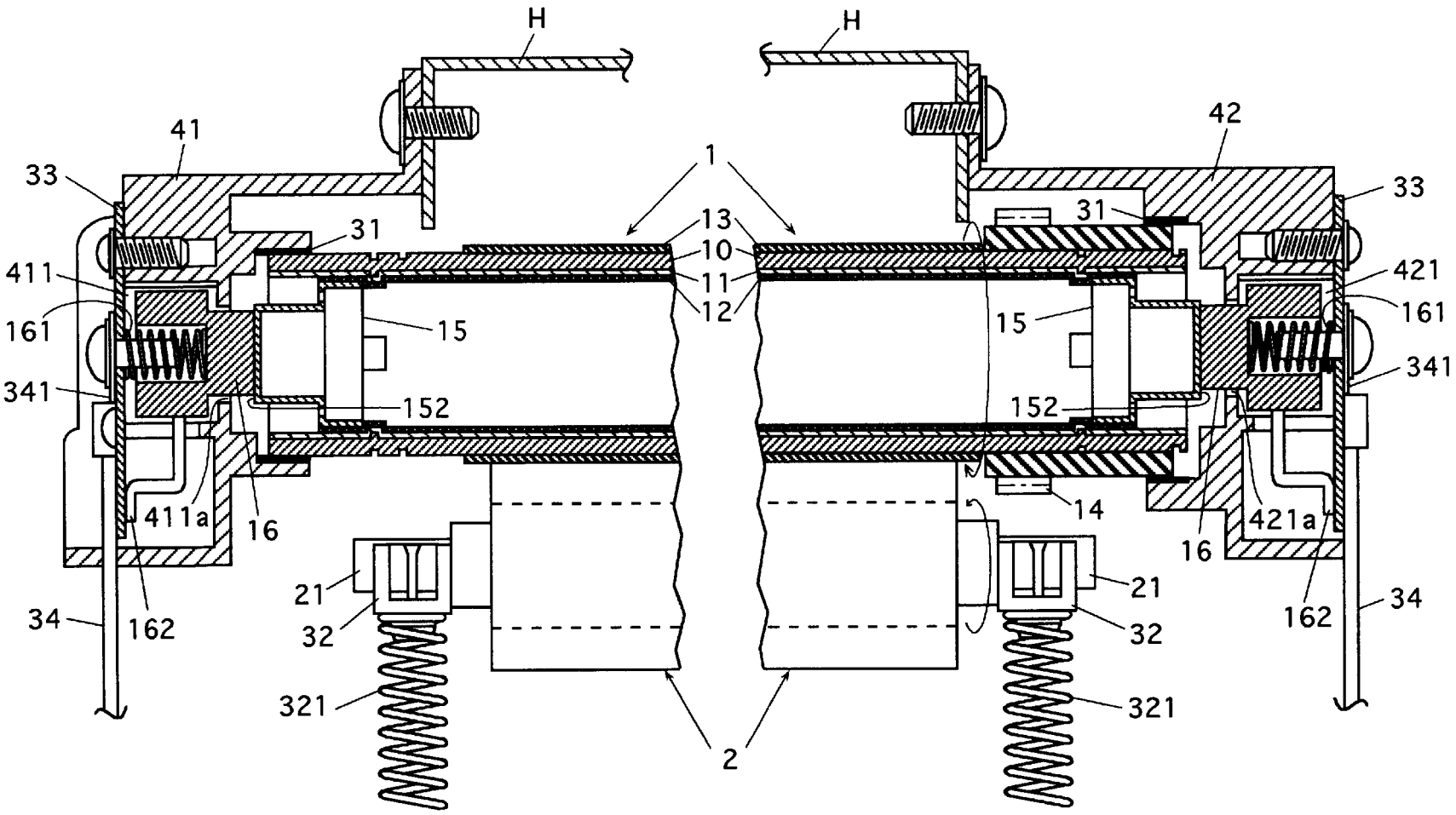
FIG. 1 is a schematic cross section of an example of a fixing device provided with a heating device according to the invention.

As already described, the invention provides the first, second and third types of heating devices.

Any type of the heating devices according to the invention can be utilized for heating an unfixed image in a fixing device which is arranged in an electrophotographic image forming apparatus such as a copying machine, printer or the like, and fixes the unfixed image such as a toner image onto a record member bearing the unfixed image.

The endless rotary member may be, for example, a roller in a columnar form. For reducing a thermal capacity and/or a weight, the endless rotary member may partially or entirely have a hollow structure. The endless rotary member may be formed of an endless structure of flexible film, sheet or thin plate instead of the roller.

The endless rotary member is provided at its peripheral surface with the resistance heating member which generates a heat when supplied with an electric current. The resistance heating member is arranged at either or both the outer and inner peripheral surfaces of the endless rotary member. The resistance heating member may be formed directly on the peripheral surface of the endless rotary member, or may be formed indirectly on the peripheral surface of the endless rotary member with an insulator or the like therebetween, if necessary. The insulator may be provided for keeping electrical insulation between the endless rotary member and the resistance heating member, if necessary. The resistance heating member rotatively moves together with the rotational movement of the peripheral surface of the endless rotary member. The endless rotary member may be provided at its outermost peripheral surface with a release layer for preventing adhesion of melted toner.

The resistance heating member is electrically connected to the current receiver member. The current receiver member is made of an electrically conductive material. The current receiver member rotates together with the endless rotary member in accordance with rotational movement of the peripheral surface of the endless rotary member.

The current supply member is in contact with the current receiver member. The current supply member is made of an electrically conductive material for establishing electrical contact between these supply and receiver members. The current supply member is to be connected to the power source. The current supply member may be connected directly to the power source or indirectly thereto through a switch, a contact of a relay or the like.

The current receiver member and the current supply member in the heating device each are at least one in number. The heating device may be provided with a pair of the current receiver members and a pair of the current supply members. The heating device s may be provided with one set of the current receiver member and the current supply member described above as well as a set of a known current receiver member and a known current supply member.

The current receiver member have a function as an electrical connection to the current supply member. The current receiver member may additionally have a function as an internal structural member for increasing a rigidity of the endless rotary member and maintaining an intended configuration thereof. For example, if the endless rotary member is formed of the hollow cylindrical roller, and the roller has a thin wall for the purpose of, e.g., reducing the thermal capacity, and therefore the roller has a low rigidity, the current receiver member arranged in the inner space of the roller may have a function of maintaining the intended configuration and rigidity of the roller. If the endless rotary member is formed of endless film or the like, the current receiver member arranged in the inner space of the film or the like may have a function of maintaining the intended configuration of the film or the like.

If the endless rotary member has at least partially a hollow structure, the current receiver member may take the form of, for example, a wall partitioning the inner space of the endless rotary member. Thereby, the current receiver member can have a function of the internal structural member described above for increasing the rigidity and others of the endless rotary member. In this case, the current receiver member may be exposed outward in the direction of the rotation axis of the endless rotary member, and the current supply member may be in contact with an exposed portion of the current receiver member from an outer side in the direction of the rotation axis of the endless rotary member.

If the endless rotary member has at least partially a hollow structure, the current receiver member may have a ring-like form and may be arranged at the inner peripheral surface of the endless rotary member. In this case, the current supply member may be in contact with the current supply member in the inner space of the endless rotary member. The current supply member may be in contact with the current receiver member, for example, in a direction crossing the direction of the rotation axis of the endless rotary member and, typically, in the direction substantially perpendicular to the direction of the rotation axis thereof. The current supply member may be in contact with the current receiver member from the outer side in the direction of the rotation axis of the endless rotary member.

The current receiver member may have a ring-like form and may be arranged at the outer peripheral surface of the endless rotary member. In this case, the current supply member may be in contact with the current receiver member, for example, in a direction crossing the direction of the rotation axis of the endless rotary member and, typically, in the direction substantially perpendicular to the direction of the rotation axis thereof.

If the endless rotary member is a roller in a columnar form or a roller having at least partially a hollow cylindrical structure, the heating device according to the invention may have the following form.

The heating device (heating roller device) includes a roller (core roller) having a peripheral surface to be rotatively moved, a resistance heating member formed at the outer and/or inner peripheral surfaces of the core roller and generating a heat when supplied with an electric current, a current receiver member electrically connected to the resistance heating member and arranged at the core roller, and a current supply member in contact with the current receiver member and to be electrically connected to a power source.

In the above heating roller device, the current receiver member may be arranged in the hollow space at an end in the direction of the rotation axis (rotation axis direction) of the roller. In this case, the current receiver member may be exposed outward in the rotation axis direction of the roller, and the current supply member may be in contact with the exposed portion of the current receiver member from the outer side in the rotation axis direction of the core roller.

In the above heating roller device, the current receiver member may be formed at the outer (or inner) peripheral surface of the roller, and may have a ring-like form. In this structure, the current supply member may be in contact with a radially outer (or inner) side of the current receiver member.

In the heating device according to the invention, when the power source supplies an electric power to the resistance heating member through the supply and receiver members, the resistance heating member generates a heat to raise the temperature of the endless rotary member. When the endless rotary member is rotated to move and rotate its peripheral surface, the current receiver member rotates together with the endless rotary member so that the rotating current receiver member slides on the current supply member.

If a pressing device is provided for pressing the current supply member against the current receiver member, the current supply member can be stably in contact with the rotating current receiver member. The pressing device may include an elastic member such as a coil spring for pushing the current supply member toward the current receiver member.

The heating devices of the first and second types will be described below more in detail.

In the heating devices of the first an described types described above, the current supply member is made of a sintered material containing copper and carbon, and, in other words, a carbon material containing copper. Thereby, the contact surface of the current supply member for contact with the current receiver member is shaved when the current receiver member slides on the current supply member so that a carbon film or layer is formed at the contact surface of the current receiver member for contact with the current supply member. In the heating device of the second type, the carbon film is formed, in advance, on the contact surface of the current receiver member for contact with the current supply member.

For facilitating formation of the carbon film on the current receiver member, the contact surface of the current receiver member for contact with the current supply member may be made of a material harder than the contact surface of the current supply member for contact with the current receiver member. The current receiver member may be made of metal material such as brass, copper or iron.

Owing to formation of the carbon film, the contact surface of the current receiver member for contact with the current supply member has reduced irregularities and therefore a high smoothness so that the contact area of the mutual contact surfaces of the receiver and supply members increases, and therefore the electrical contact resistance at the mutual contact surfaces can be reduced. Thereby, a voltage drop at the mutual contact surfaces can be suppressed, which ensures application of an intended voltage to the resistance heating member.

In the heating device of the second type described above, since the carbon film is formed, in advance, on the contact surface of the current receiver member for contact with the current supply member, a small electrical contact resistance can be kept at the mutual contact surfaces of the receiver and supply members from the start of use. The carbon film on the surface of the current receiver member may be formed, for example, by sliding the current receiver member with respect to the current supply member.

A content of the copper in the current supply member which is made of the sintered material containing copper and carbon is in a range from 55 wt % (percentages by weight) to 80 wt %. This range of the copper content of the current supply member is determined based on the finding from results of experiments which will be described later. If the copper content were smaller than 55 wt %, the electrical resistance at the mutual contact surfaces of the supply and receiver members would be excessively large. Further, if the copper content were smaller than 55 wt %, a specific resistance of the current supply member would impracticably increase. If the copper content were larger than 80 wt %, formation of the carbon film on the current receiver member would be suppressed. Further, a bonding force of sintered materials forming the current supply member would be excessively small so that the current supply member would be excessively worn.

For improving the sliding property at the mutual slide contact surfaces of the supply and receiver members, the sintered material containing copper and carbon forming the current supply member may further contain a solid lubricant. A content of the solid lubricant in the sintered material is preferably in a range from 1 wt % to 5 wt %. This range is determined based on a finding from the results of the experiments which will be described later. If the content of solid lubricant were smaller than 1 wt % or larger than 5 wt %, the current supply member would be excessively worn. The solid lubricant may be, for example, molybdenum disulfide.

The heating device of the third type will now be described below more in detail.

In the heating device of the third type, the contact surface of the current receiver member for contact with the current supply member is made of a material harder than the contact surface of the current supply member for contact with the current receiver member.

The supply and receiver members satisfying the above relationship may be made of the following materials. For example, the current supply member is made of an electrically conductive material containing carbon. The conductive material containing carbon may be, for example, material containing carbon and copper (carbon material containing copper) or material containing carbon and silver (carbon material containing silver). The current receiver member may be made of an electrically conductive metal material such as brass, copper or iron.

In the heating device of the third type, the surface roughnesses of the current receiver member and the current supply member at the mutual contact surfaces satisfy the relationship of (surface roughness of the current receiver member) $\leqq$ (surface roughness of the current supply member). Further, these current supply and receiver members have the following surface roughnesses. The surface roughness Ra of the current receiver member is in a range from 0.3 $\mu$m to 5.5 $\mu$m. The surface roughness Ra of the current supply member is equal to or smaller than 5.5 $\mu$m. These ranges are determined based on a finding from results of the experiments which will be described later. In case that the current supply member is made of the electrically conductive material containing carbon, and the current receiver member is made of the electrically (conductive metal material as described above, and when the contact surfaces satisfy the relationship of (surface roughness of the current receiver member) $\leqq$ (surface roughness of the current supply member), and the current supply member has the surface roughness Ra not exceeding 5.5 $\mu$m, a smooth carbon film having reduced irregularities is formed on the contact surface of the current receiver member for contact with the current supply member owing to sliding of these members so that the electrical contact resistance at the mutual contact surfaces can be small. Thereby, a voltage drop at the mutual contact surfaces can be reduced, and an intended voltage can be applied to the resistance heating member. If the surface roughness Ra of the current receiver member were larger than 3 μm, the quantity of wear of the current supply member would be larger. Therefore, it is preferable that the contact surface of the current receiver member for contact with the current supply member has the surface roughness Ra of 3 μm or less. If the surface roughness Ra of the current receiver member were smaller than 0.3 μm, formation of the carbon film would be suppressed, and it would be difficult to reduce the contact resistance at the mutual contact surfaces. Therefore, it is preferable that the current receiver member has the surface roughness Ra of 0.3 μm or more.

Embodiments of the invention will now be described below with reference to the drawings.

(First Embodiment)

FIG. 1 is a schematic cross section showing an example of a heating roller device (heating device) according to the invention. More specifically, FIG. 1 is a schematic cross section of an example of a fixing device provided with the heating roller device. This fixing device is arranged in an electrophotographic image forming apparatus such as a copying machine, a printer or a facsimile machine, and can be utilized for fixing an unfixed toner image onto a record member or sheet bearing the unfixed image by applying a heat and a pressure thereto.

This fixing device is provided with the heating roller device including a heating roller 1 and others as well as a pressure roller 2 opposed to the heating roller 1.

The heating roller 1 is rotatably carried at its opposite ends by bearings 31. The bearing 31 at the left position in the figure is supported by a holder 41 which is fixed to a fixing device housing H by screws. The bearing 31 at the right position in the figure is supported by a holder 42 which is fixed to the housing H by screws. A ring gear 14 is arranged around the outer peripheral surface of the right end, in the figure, of the heating roller 1. Although not shown, the ring gear 14 is coupled to an electric motor via a gear train. The motor can drive the heating roller 1 to move and rotate its peripheral surface.

The pressure roller 2 is provided at its opposite ends with shafts 21 which are rotatably supported by support members 32, respectively, and is pressed against the heating roller 1 by springs 321 which are in contact, in one direction, with the support members 32, respectively. The pressure roller 2 is driven to rotate by the rotating heating roller 1 or by a record member which is fed into a position between both the rollers and is moved thereby.

The heating roller 1 has a cylindrical hollow core roller 10 as an endless rotary member. The core roller 10 is made of aluminum alloy in this embodiment. The inner peripheral surface of the core roller 10 is coated with an insulating layer 11 and a resistance heating member 12 taking a form of a layer (resistance heating layer 12) in this order. A release layer 13 is formed on the outer peripheral surface of the core roller 10.

The insulating layer 11 is formed between the resistance heating layer 12 and the core roller 10 for electrical insulation between them, and is made of a heat resisting and electrically insulating resin such as a polyimide in this embodiment.

The resistance heating layer 12 generates a Joule heat when supplied with an electric current and is made of ceramics containing barium titanates in this embodiment.

The release layer 13 is provided for facilitating the peeling or releasing of the heated toner image from the heating roller 1 when the record member bearing the unfixed toner image moves between the heating roller 1 and the pressure roller 2 opposed thereto, and is made of polytetrafluoroethylene in this embodiment.

These insulating layer 11, resistance heating layer 12 and release layer 13 rotate together with the core roller 10.

Current receiver members 15 are arranged at the opposite ends, in the rotation axis direction of the core roller 10 (heating roller 1), of the heating roller 1. Each current receiver member 15 is fitted to the inner peripheral surface of the core roller 10 in this embodiment. The current receiver member 15 has a hat-like form and has a flat circular top surface 152 having a center line coincident with the rotation axis of the roller 1. Each current receiver member 15 forms a wall partitioning an inner space of the core roller 10. Thereby, each current receiver member 15 functions as an internal structural member for increasing a rigidity of the core roller 10 and others. The current receiver member 15 is made of an electrically conductive material, and more specifically is made of brass in this embodiment. The current receiver member 15 is fixed to the resistance heating layer 12 by an electrically conductive adhesive, and is electrically connected to the resistance heating layer 12. The current receiver member 15 rotates together with the core roller 10.

Current supply members 16 are in surface-contact with the flat top surface 152 of each current receiver member 15 from an outer side in the rotation axis direction of the heating roller 1, respectively.

The current supply member 16 is made of a sintered material containing copper, carbon and molybdenum disulfide serving as a solid lubricant, in other words, is made of a carbon material containing copper. The contents of copper, carbon and molybdenum disulfide in the current supply member 16 are 55 wt %, 42 wt % and 3 wt % in this embodiment, respectively. The reason will be described later.

The contact surface (i.e., flat top surface 152 in this embodiment) of the current receiver member 15 for contact with the current supply member 16 is processed to have a surface roughness Ra in a range from about 0.3 to 3.0 μm. The contact surface of the current supply member 16 for contact with the current receiver member 15 is processed to have an initial surface roughness Ra of about 5.0 μm. Therefore, a relationship of (surface roughness of the current receiver member) ≦ (surface roughness of the current supply member) is established. The reason will be described later.

The current supply member 16 at the left position in FIG. 1 is fitted into a concavity 411 formed at the holder 41, and has a portion which is projected through an aperture 411*a* formed at the bottom of the concavity 411 near the roller 1, and is opposed to the current receiver member 15. The current supply member 16 at the left position is brought into contact at an appropriate pressure with the left current receiver member 15 by a spring 161 arranged in the concavity 411. Likewise, the current supply member 16 at the right position is fitted into a concavity 421 at the right holder 42, and has a portion which is projected through an aperture 421*a* formed at the bottom of the concavity 421, and is opposed to the right current receiver member 15. The current supply member 16 at the right position is brought into contact at an appropriate pressure with the right current receiver member 15 by a spring 161 arranged in the concavity 421. Each spring 161 has an axially outer end seated on an end plate 33 which is fixed to an outer end of the holder by screws. Owing to the above structure, an electrical contact is kept between the current receiver member 15 and the current supply member 16 during rotation of the current receiver member 15 together with the heating roller 1. Each current supply member 16 is electrically connected to the end plate 33 made of an electrically conductive material through a lead wire 162.

The left end plate 33 is connected to an electric wire 34 via a crimp contact 341. The other end of the electric wire 34 is connected to a terminal of a power source 8 (see FIG. 2). Likewise, the right end plate 33 is connected to a right electric wire 34 via a crimp contact 341. The other end of this right electric wire 34 is connected to another terminal of the power source 8 via a contact of a solid-state relay SSR (see FIG. 2).

Figure 2:
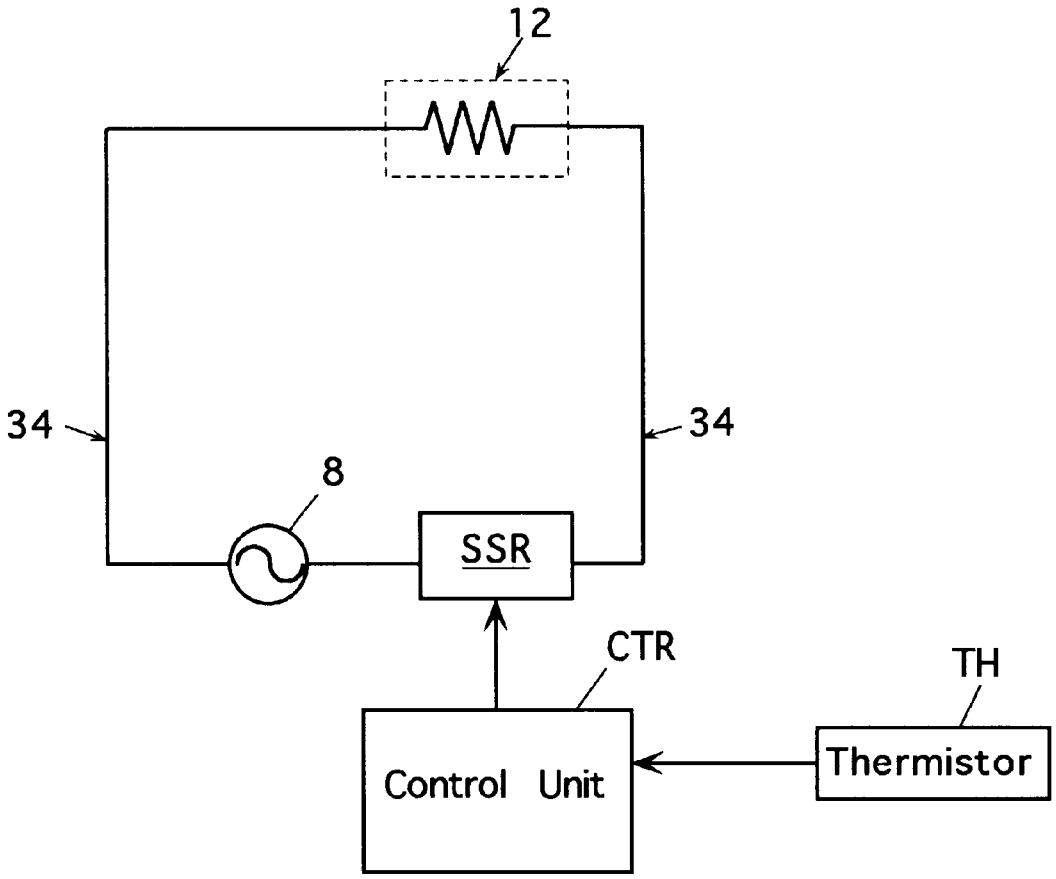
FIG. 2 schematically shows a power supply circuit for a resistance heating layer and a control circuit for power supply control.

FIG. 2 schematically shows a power supply circuit for the resistance heating layer 12 together with a control unit for the power supply. In FIG. 2, the current receiver member 15, current supply member 16, lead wire 162 and others are not shown.

The resistance heating layer 12 is supplied with an electric current from the power source 8 when the contact of the relay SSR is closed. The relay SSR is connected to a control unit CTR including a central processing unit (CPU) controlling an entire operation of the fixing device. The control unit CTR can open and close the contact of the relay SSR. The control unit CTR opens and closes the contact of the relay SSR based on a temperature of the heating roller 1 which is detected by a thermistor TH (not shown in FIG. 1), i.e., a temperature detecting element in contact with the outer peripheral surface of the release layer 13 of the heating roller 1. In this embodiment, the control unit CTR controls the power supply to the resistance heating layer 12 for attaining a predetermined temperature of the heating roller 1 based on the temperature of the heating roller 1 detected by the thermistor TH.

A temperature detecting element for preventing abnormal rising of the temperature of the heating roller 1 may be employed independently of the thermistor TH for control of the temperature of the heating roller 1. A safety switch, which is opened and closed based on the temperature detected by this independent temperature detecting element, may be connected in series to the power source 8 and the relay SSR in the power supply circuit for the resistance heating layer 12 shown in FIG. 2. Thereby, the safety switch can interrupt the power supply circuit before the heating roller 1 and its peripheral parts are thermally damaged even in such a case that the control unit CTR cannot normally control the power supply due to any reason and thereby the temperature of the heating roller 1 tends to rise abnormally. The temperature detecting element for the safety switch can be likewise arranged in contact with the outer peripheral surface of the heating roller 1. This temperature detecting element may be a thermistor or a thermocouple. The safety switch having a temperature detection function may be formed of a temperature fuse or a thermostat.

According to the fixing device described above, the unfixed toner image on the record member is fixed thereto in the following manner. The control unit CTR closes the contact of the relay SSR to supply the power from the power source 8 to the resistance heating layer 12 through the current supply member 16, current receiver member 15 and others so that the resistance heating layer 12 generates a Joule heat which is applied to the heating roller 1 through its inner peripheral surface. Since the resistance heating member is employed as the heating source of the heating roller 1, the temperature of the heating roller 1 rapidly rises. During this operation, the power supply is controlled based on the temperature of the heating roller 1 detected by the thermistor TH so that the heating roller 1 is kept at a predetermined fixing temperature. The motor (not shown) drives the heating roller 1 to rotate through the gear train coupled to the motor so that the record member bearing the unfixed image moves between the heating roller 1 at the fixing temperature and the pressure roller 2 pressed against it, whereby the unfixed image is fixed onto the record member under the heat and pressure.

In the image fixing operation and others, when the heating roller 1 is driven to rotate, the current receiver member 15 rotates together with the roller 1 so that the current receiver member 15 slides on the current supply member 16. Since the current receiver member 15 made of brass is harder than the current supply member 16 made of carbon material containing copper, the contact surface of the current supply member 16 is primarily shaved at the mutual contact surfaces of receiver and supply members 15 and 16. A carbon film is formed on the contact surface of the current receiver member 15 as a result of this shaving of the current supply member 16. The carbon film which is formed in this manner reduces irregularities of the contact surface of the current receiver member 15 for contact with the current supply member 16, and thus smoothens the contact surface. This increases the contact area of these members at the mutual contact surfaces, and reduces the electrical contact resistance at the mutual contact surfaces. Therefore, the voltage drop at the mutual contact surfaces can be reduced so that an intended voltage can be applied to the resistance heating layer 12.

The current supply member 16 will be further described below. As already described, the current supply member 16 is made of a sintered material containing copper and carbon, and in other word a carbon material containing copper. Since the current supply member 16 slides on the current receiver member 15 as already described, it has a function of so-called a brush. The brush made of a carbon material containing copper belongs to a class of metal material brush among those of generally used brushes for electrical uses. The metal material brush has a lower specific resistance than a carbon material brush primarily made of carbon black and a graphite material brush primarily made of natural graphite. However, the metal material brush has a lower sliding property than the carbon material brush and graphite material brush. Therefore, the current supply member contains molybdenum disulfide ($MoS_2$) as a solid lubricant in this embodiment.

In this embodiment, the current supply member 16 is manufactured in the following manner.

Fine powder of natural graphite as carbon having an average particle diameter of 0.5 $\mu$m, copper powder having an average particle diameter of 0.5 $\mu$m and molybdenum disulfide having an average particle diameter of 0.5 $\mu$m are mixed at rates of 42 wt %, 55 wt % and 3 wt %, respectively, and are sufficiently stirred by a blender without using solvent.

Then, the mixed powder of natural graphite, copper and molybdenum disulfide is supplied into a mold, and a compression molding is performed by a pressure molding machine at a pressure from 1 to 2 ton/cm$^2$.

Then, the compression-molded piece is sintered in an argon gas atmosphere for 2 hours at 800° C. so that the sintered piece of the natural graphite, copper and molybdenum disulfide is formed.

The sintered piece is cut into the form described before, and then is polished with a file to provide the contact surface having the surface roughness Ra of 5 μm for contact with the current receiver member. In this manner, the current supply member 16 is completed. Therefore, the carbon film, which is formed at the contact surface of the current receiver member 15 for contact with the current supply member 16 as a result of sliding between the supply and receiver members 16 and 15, is a graphite film in this embodiment.

Description will now be given on the reason by which the copper, carbon and molybdenum disulfide in the current supply member 16 are 55 wt %, 42 wt % and 3 wt %, respectively.

(A) Content of Copper in the Current Supply Member and the Electrical Contact Resistance The electrical contact resistance at the mutual contact surfaces of the current supply member 16 made of carbon material containing copper and the current receiver member 15 changes depending on content of the copper in the current supply member 16. Accordingly, an experiment was performed for measuring the contact resistance at the mutual contact surfaces of the supply and receiver members with various values of the content of copper in the current supply member.

This experiment was performed with the heating roller device of the type shown in FIG. 1. The following current supply members were used. One of them is made of carbon material containing copper as well as molybdenum disulfide as a solid lubricant at 3 wt %. The other is made of carbon material which contains copper but does not contain a solid lubricant. The current receiver member is made of brass.

Figure 3:
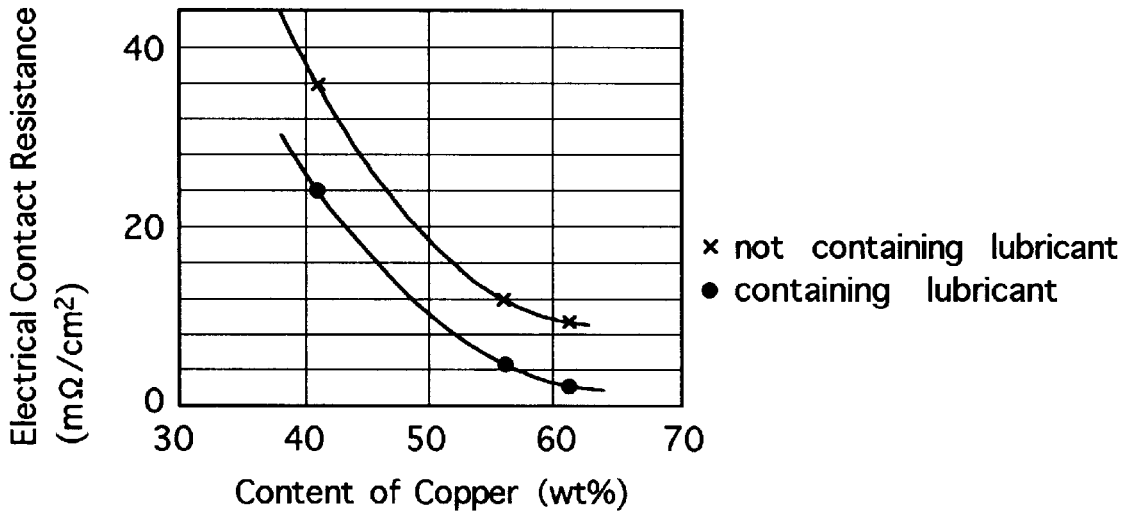
FIG. 3 shows a relationship between a content of copper in a current supply member, made of a material containing copper and carbon, and a contact resistance at mutual contact surfaces of a current supply member and a current receiver member.

Results of the experiment is shown in FIG. 3. FIG. 3 shows a relationship between the content of copper in the current supply member made of carbon material containing copper and the electrical contact resistance per unit area at the mutual contact surfaces.

From FIG. 3, it can be understood that the contact resistance at the mutual contact surfaces increases with decrease in content of the copper in the current supply member. When the content of copper in the current supply member is 55 wt % or more, the contact resistance can take on a value not causing a practical problem. Thereby, the voltage drop at the mutual contact surfaces can be reduced, and therefore the voltage can be stably applied to the resistance heating layer.

From FIG. 3, it can also be understood that the current supply member made of carbon material containing both the copper and lubricant exhibits a smaller contact resistance at the mutual contact surfaces than the current supply member made of carbon material which contains copper at the same rate but does not contain the lubricant.

The current receiver member made of brass can be replaced with the current receiver member made of copper or ion, in which case an effect similar to that in FIG. 3 can be achieved.

(B) Content of Copper in the Current Supply Member and Specific Resistance of the Current Supply Member The content of copper in the current supply member also affects the specific resistance (resistivity) of the current supply member. Accordingly, an experiment was performed to determine the specific resistance of the current supply member with various values of the content of copper in the current supply member.

Figure 4:
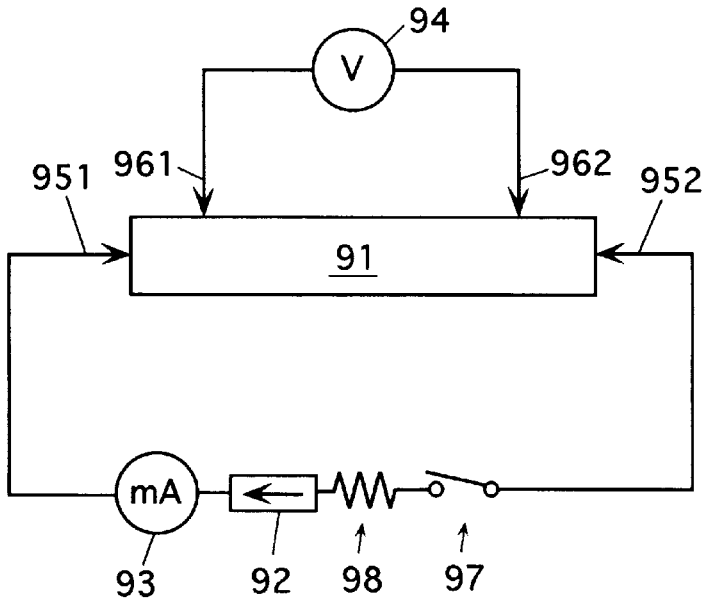
FIG. 4 shows a laboratory device for measuring a specific resistance of the current supply member.

This experiment was performed with a laboratory device for measuring a specific resistance shown in FIG. 4. As the current supply members, test pieces 91 of 10 mm×10 mm×60 mm were used. The test pieces 91 were prepared by cutting into the above sizes the current supply members, which were removed from the heating roller device shown in FIG. 1 after driving and rotating the heating roller in the heating roller device in FIG. 1 under the following four conditions (b1)–(b4). These four conditions relate to the surface temperature (set temperature) of the heating roller and the drive time of the heating roller.

Under the condition (b1), the surface temperature was equal to the room temperature (25° C.), and the drive time was equal to the time required for image fixing of one sheet and therefore was substantially or approximately 0 hour.

Under the condition (b2), the surface temperature was 200° C., and the drive time was substantially 0 hour.

Under the condition (b3), the surface temperature was equal to the room temperature, and the drive time was 750 hours.

Under the condition (b4), the surface temperature was 200° C., and the drive time was 750 hours. Under the conditions that the surface temperature of the heating roller was equal to the room temperature, a current was not supplied to the resistance heating layer.

Each of the test pieces 91 was made of carbon material containing copper and molybdenum disulfide as a solid lubricant at 3 wt %. The test piece 91 contained copper at 45, 55 or 60 wt %.

A terminal 951 which is connected to a terminal of a constant current source 92 via an ampere meter 93 was crimped to a lengthwise end of the test piece 91. A terminal 952 which is connected to another terminal of the constant current source 92 via a switch 97 and a resistance 98 was crimped to the other end of the test piece 91. Terminals 961 and 962 connected to opposite terminals of a potentiometer 94 were brought into contact with a lengthwise central portion of the test piece 91 with a space between each other. This space between the terminals 961 and 962 was ⅔ of the length of the test piece 91, i.e., equal to 40 mm. The currents of 3, 6, 9, 12 or 15 mA were supplied to the test piece 91 for measuring the voltage drop by the potentiometer 94.

Figure 5:
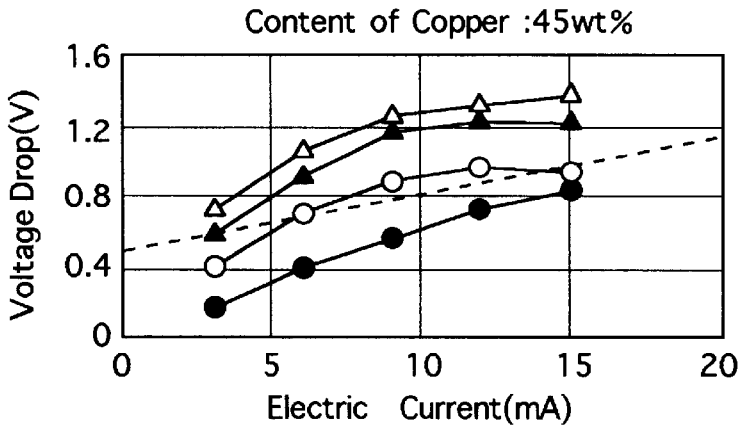
FIG. 5 shows a voltage drop which occurs at a carbon material containing copper at 45 wt % when a current flows through the carbon material.
Figure 6:
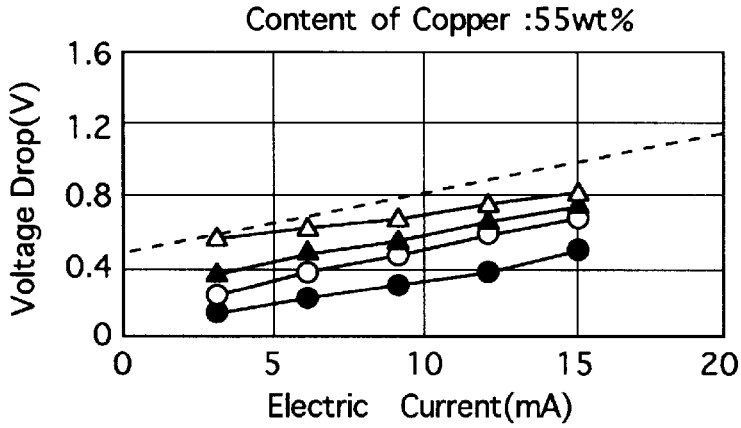
FIG. 6 shows a voltage drop which occurs at a carbon material containing copper at 55 wt % when a current flows through the carbon material.
Figure 7:
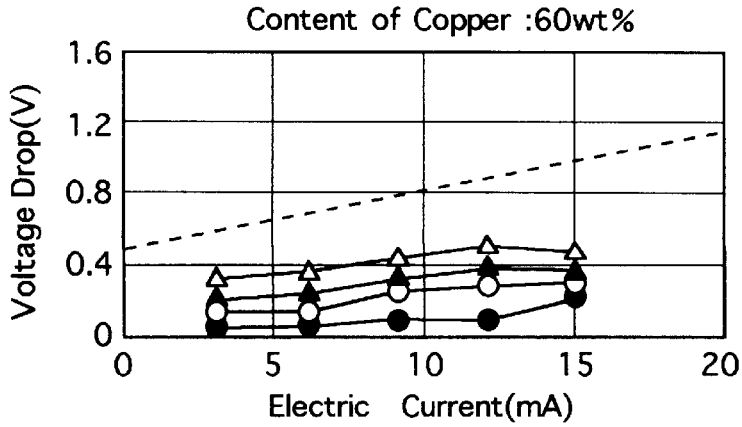
FIG. 7 shows a voltage drop which occurs at a carbon material containing copper at 60 wt % when a current flows through the carbon material.

Results of this experiment are shown in FIGS. 5, 6 and 7. FIG. 5 shows the result with the test piece made of carbon material containing copper at 45 wt %. FIG. 6 shows the result with the test piece made of carbon material containing copper at 55 wt %. FIG. 7 shows the result with the test piece made of carbon material containing copper at 60 wt %. In FIGS. 5, 6 and 7, marks "○" represent the results under the condition (b1). Marks "●" represent the results under the condition (b2). Marks "Δ" represent the result under the condition (b3). Marks "▲" represent the results under the condition (b4). In these figures, dotted lines represent the level of voltage drop under which no practical problem arises.

It can be seen from FIGS. 5 to 7 that the voltage drop at the test piece deemed as the current supply member lowers than the allowable level when the content of copper in the test piece is 55 wt % or more regardless of the conditions relating to the drive time of the heating roller and the surface temperature thereof. The resistivity ρ (specific resistance) of the test piece can be expressed as $\rho = V \cdot S/(I \cdot L)$ where S ($=10\times10\ mm^2$) represents the sectional area of the test piece, L (=40 mm) represents the length thereof, I represents the current supplied to the test piece and V represents the voltage drop. Therefore, the fact that the voltage drop V is lower than the allowable level means that the resistivity ρ of the test piece is smaller than the allowable level. Therefore, the current supply member having the copper content of 55 wt % or more can have a low resistance, and can reduce the voltage drop so that an intended voltage can be applied to the resistance heating layer.

Figure 8:
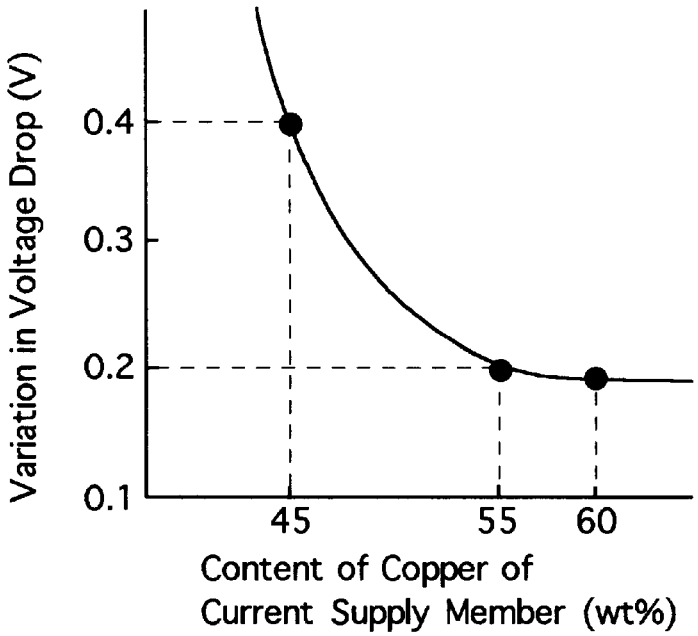
FIG. 8 shows a variation in voltage drop which occurs at the current supply member when a drive time changes substantially from 0 hour to 750 hours and a surface temperature of a heating roller is at a room temperature.
Figure 9:
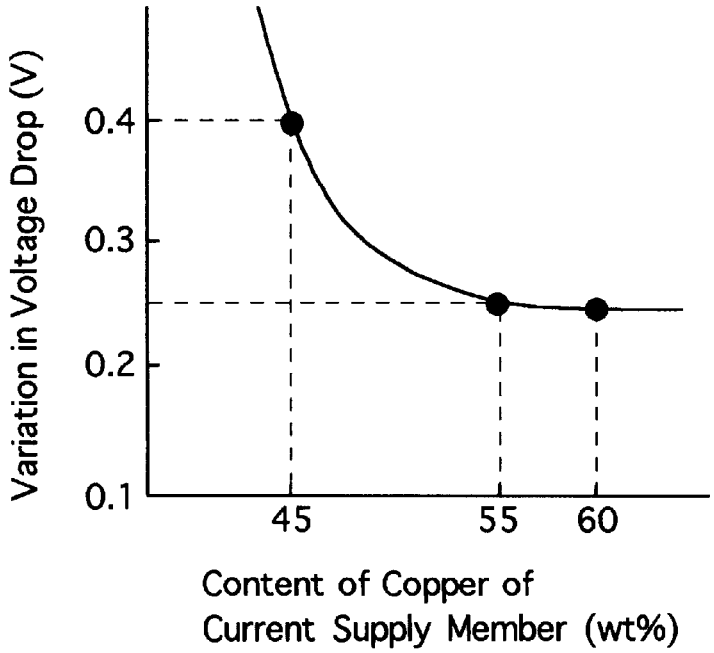
FIG. 9 shows a variation in voltage drop which occurs at the current supply member when a drive time of the heating roller is substantially 0 hour and a surface temperature of the heating roller rises from the room temperature to 200° C.

FIGS. 8 and 9 show the results of the experiments shown in FIGS. 5 to 7 which are considered from another viewpoint.

FIG. 8 shows differences between the data under the above condition (b3), which are indicated by the marks "Δ" in FIGS. 5 to 7, and the data under the above condition (b1), which are indicated by the marks "○" in FIGS. 5 to 7, with the test pieces 91 containing copper at 45, 55 or 60 wt %, respectively. In other words, FIG. 8 shows a variation in voltage drop caused by change in drive time from substantially 0 hour (i.e., initial stage) to 750 hours with the surface temperature cf the heating roller kept at a room temperature. All the data were obtained when the test pieces 91 were supplied with the current of 9 mA.

FIG. 9 shows differences between the data under the above condition (b1), which are indicated by the marks "○" in FIGS. 5 to 7, and the data under the above condition (b2), which are indicated by the marks "●" in FIGS. 5 to 7, with the test pieces 91 containing copper at 45, 55 or 60 wt %, respectively. In other words, FIG. 9 shows a variation in voltage drop in accordance with change in surface temperature from the room temperature to 200° C. with the heating roller drive time of approximately 0 hour. All the data were obtained when the test pieces 91 were supplied with the current of 9 mA.

From FIGS. 8 and 9, it can be understood that the variation in voltage drop can be small even when the drive time or the surface temperature of the heating roller changes, if the test piece handled as the current supply member contains the copper at about 55 wt % or more. The variation in voltage drop is substantially constant even if the copper content of the test piece increases from about 55 wt %.

(C) Copper Content of the Current Supply Member and Worn Quantity of the Current Supply Member The copper content of the current supply member affects the worn thickness or quantity of the current supply member at the mutual contact surfaces of the current supply member and the current receiver member. Accordingly, an experiment was performed to determine the worn quantity of the current supply member at the mutual contact surfaces of the supply and receiver members with various values of the content of copper in the current supply member.

This experiment was performed with the heating roller device of the type shown in FIG. 1. The worn quantity of the contact surface of the current supply member for contact with the current receiver member was determined after rotative driving of the heating roller for 750 hours. The rotative driving of the heating roller was performed under two conditions that the current was supplied through the supply and receiver members and that the current was not supplied. The worn quantities of the current supply members were determined under both the conditions. The current supply member was made of carbon material containing copper and molybdenum disulfide as a solid lubricant at 3 wt %. The current receiver member was made of brass.

Figure 10:
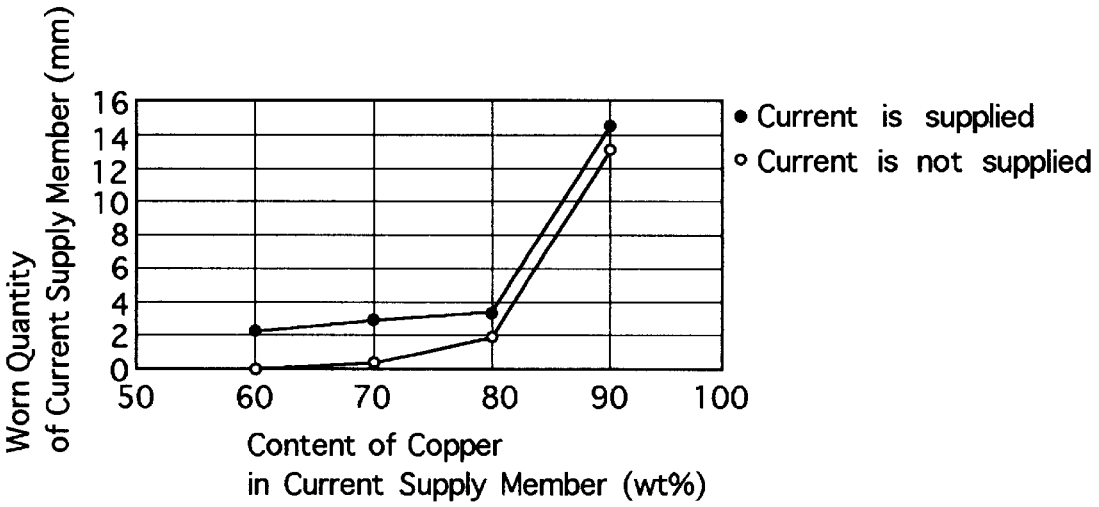
FIG. 10 shows a relationship between a content of copper in the current supply member, made of a material containing carbon and copper, and a worn quantity of the current supply member.

The results are shown in FIG. 10.

It can be understood from FIG. 10 that the copper content of the current supply member exceeding 80 wt % remarkably increases the worn quantity of the current supply member. Therefore, it is preferable that the copper content of the current supply member is 80 wt % or less. Further, the content of the current supply member is preferably 70 wt % or less when the state of the carbon film, which is formed at the contact surface of the current receiver member for contact with the current supply member, is taken into consideration.

The current receiver member which is made of copper or ion instead of brass can achieve an effect similar to that in FIG. 10.

(D) Lubricant Content of the Current Supply Member and Worn Quantity of the Current Supply Member The content of the solid lubricant in the current supply member affects the worn quantity of the current supply member at the mutual contact surfaces of the supply and receiver members. Accordingly, an experiment was performed for determining the worn quantity of the current supply member at the mutual contact surfaces of the supply and receiver members with various values of the content of the solid lubricant in the current supply member.

This experiment was performed with the heating roller device of the type shown in FIG. 1. The current supply member was made of carbon material containing copper and molybdenum disulfide as a solid lubricant. The current supply member contained the copper at 55 wt %. The current receiver member was made of brass.

Figure 11:
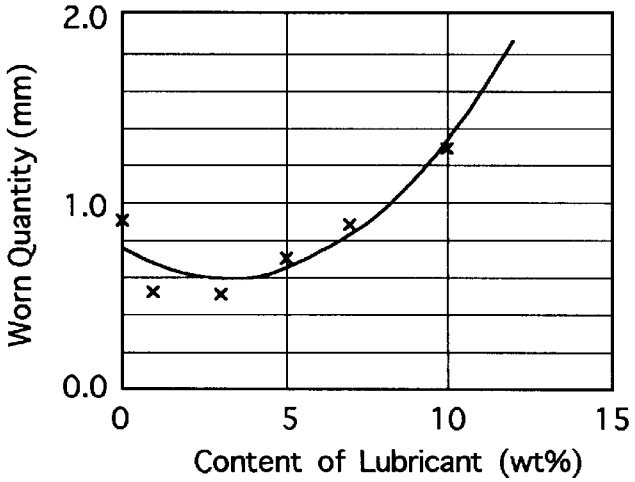
FIG. 11 shows a relationship between a content of a lubricant of a current supply member, made of a material containing carbon, copper and lubricant, and a worn quantity of the current supply member at the mutual surfaces of the current supply member and a current receiver member.

The results are shown in FIG. 11.

It can be understood from FIG. 11 that the lubricant content of the current supply member in a range from about 1 to about 5 wt % can suppress the wear of the current supply member at the mutual contact surfaces.

The current receiver member which is made of copper or ion instead of brass can achieve an effect similar to that in FIG. 11.

(E) Surface Roughnesses of the Current Receiver Member and the Current Supply Member Description will now be given on the reason why the surface roughnesses of the receiver and supply members at the mutual contact surfaces of the current receiver member 15 and the current supply member 16 are set to satisfy the relationship that the surface roughness Ra (about 0.3–3.0 μm in this embodiment) of the current receiver member is equal to or smaller than the surface roughness Ra (initially about 5.0 μm in this embodiment) of the current supply member.

The state of the carbon film formed at the contact surface of the current receiver member for contact with the current supply member is affected by the surface roughness of the current receiver member at the mutual contact surfaces, the surface roughness of the current supply member at the mutual contact surfaces, and the difference between these surface roughnesses. These factors also affect the shaved thickness or quantity (worn quantity) of the current supply member.

Accordingly, an experiment was performed to determine the state of formation of the carbon film, shaved quantity and others with various values of the surface roughness of the current receiver member at the mutual contact surfaces between the receiver and supply members and various values of the initial surface roughness of the current supply member before the first sliding.

This experiment was performed with the heating roller device of the type shown in FIG. 1. The states and others of the formed carbon films were determined after the heating roller was driven continuously for 100 hours at the same rotation speed as that in the operation of fixing the toner image onto the record member. The current supply member was made of carbon material containing copper. The current receiver member was made of brass.

Results of the experiment are shown in the following table 1 and FIG. 12.

Figure 12:
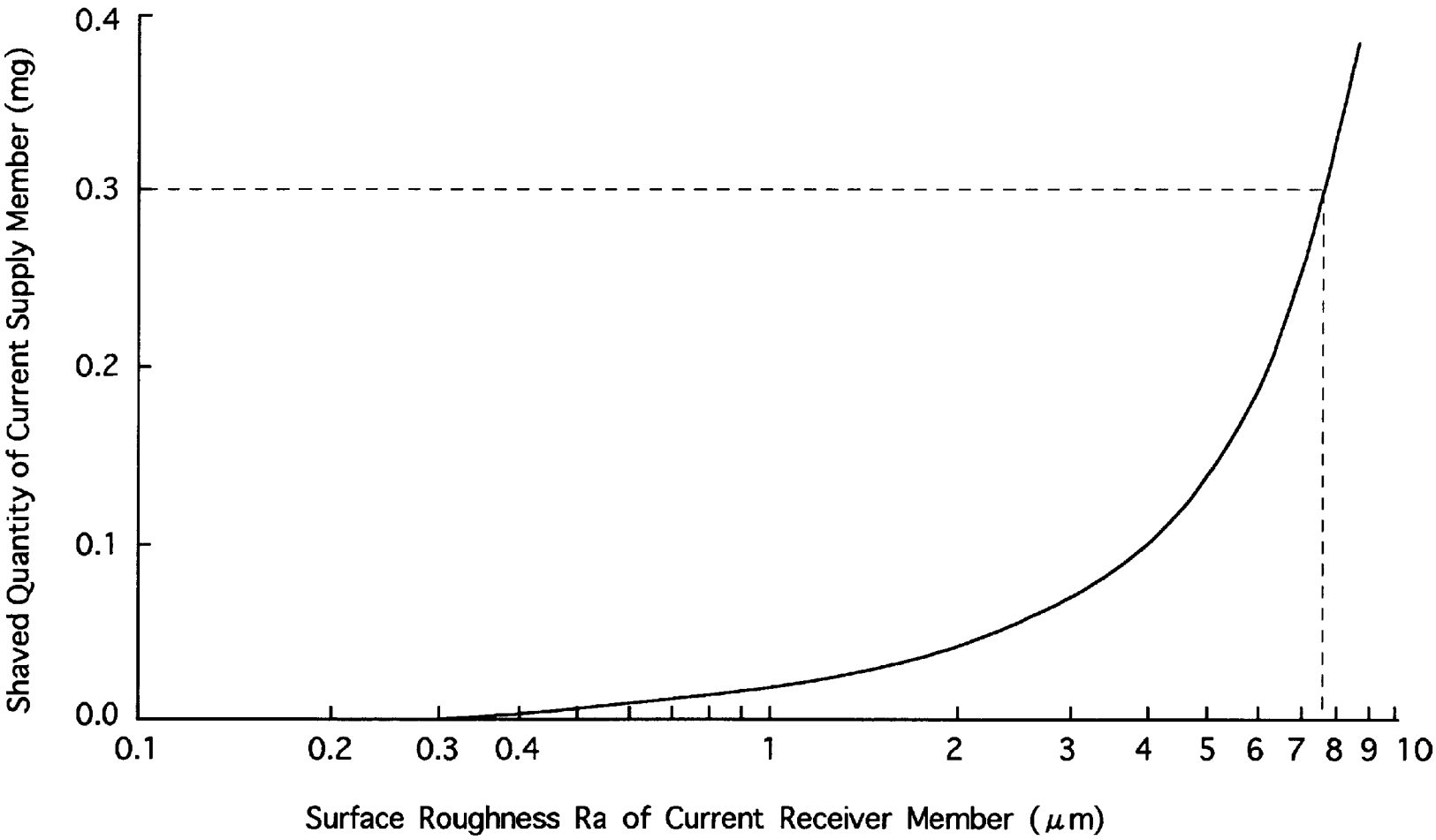
FIG. 12 shows a relationship between a surface roughness of the current receiver member at the mutual contact surfaces of the receiver and supply members and a shaved quantity of the current supply member.

FIG. 12 shows a relationship between the surface roughness of the current receiver member at the mutual contact surfaces and the shaved quantity of the current supply member. The results in FIG. 12 were obtained with the current supply member having the typical initial surface roughness Ra of 5.0 μm at the mutual contact surfaces.

TABLE 1

| | Surface Roughness Ra of Receiver Member (μm) | | | | |
|---|---|---|---|---|---|
| I/Ra* (μm) | 0.3 | 1.0 | 3.0 | 5.0 | 5.5 |
| 0.5 | Δ | X | X | X | X |
| 1.0 | ○ | Δ | X | X | X |
| 3.0 | ○ | ○ | Δ | X | X |
| 5.0 | ○ | ○ | ○ | Δ | X |
| 5.5 | X' | X' | X' | X' | X' |

I/Ra*: initial surface roughness Ra of the current supply member

In the table 1, "O" represents that a smooth carbon film was formed on the surface of the current receiver member without significant irregularities, and that the shaved quantity of the current supply member was small. "X" represents that a carbon film was formed on the surface of the current receiver member, but the formed carbon film did not have a sufficient smoothness because the surface of the current receiver member which was harder than the current supply member had excessively large irregularities. Thus, the mark "X" represents that the contact resistance at the mutual contact surfaces of the supply and receiver members was not reduced and an intended voltage could not be applied to the resistance heating layer. "Δ" represents that a smooth carbon film with less irregularities was formed on the surface of the current receiver member, but the following phenomena were found. In the case where the current receiver member had the surface roughness Ra of 0.3 μm and the current supply member had the surface roughness Ra of 0.5 μm, the current supply member was not shaved rapidly because the current receiver member had the smooth surface so that it took a long time for forming the carbon film on the contact surface of the current receiver member for contact with the current supply member. In the case where the receiver and supply members had the equal surface roughnesses, the shaved quantity of the current supply member was large, and the shaved quantity increases with increase in surface roughness of each member. However, "Δ" represents the allowable results causing no practical problem. "X'" represents that it was difficult to form a smooth carbon film with the current supply member having the surface roughness Ra exceeding 5.5 μm even if the relationship of (surface roughness of current receiver member) ≦ (surface roughness of current supply member) was satisfied. However, the current supply member having the surface roughness Ra equal to 5.5 μm could be practically used.

From table 1, it can be understood that the practically usable carbon film, which is smooth and have less irregularities, was formed on the surface of the current receiver member, when the surface roughnesses of the supply and receiver members at the mutual contact surfaces of these members satisfy the relationship of (surface roughness of current receiver member) ≦ (surface roughness of current supply member), and the contact surface of the current supply member has the surface roughness Ra of 5.5 μm or less (preferably lower than 5.5 μm, and more preferably lower than 5.0 μm). If the above two relationships or conditions are satisfied, the mutual contact area of the supply and receiver members can be sufficiently large, and the contact resistance at the mutual contact surfaces can be reduced. Thereby, lowering of the voltage across the opposite ends of the resistance heating layer 12, which may be caused by increase in contact resistance at the mutual contact surfaces, can be suppressed so that an intended voltage can be stably applied to the resistance heating layer 12.

From table 1, it can also be understood that the allowable surface roughness Ra of the current receiver member is 5.5 μm or less. Preferably, the surface roughness Ra is lower than 5.5 μm, and more preferably is 5.0 μm or less.

From FIG. 12, it can be understood that the shaved quantity (worn quantity) of the current supply member is reduced when the contact surface of the current receiver member has the surface roughness Ra of 3 μm or less. When the shaved quantity of the current supply member exceeds about 0.3 mg, shaved powder could be visibly confirmed. Therefore, it is further preferable that the contact surface of the current receiver member has the surface roughness Ra of 3 μm or less. If the surface roughness Ra of the contact surface of the current receiver member is smaller than 0.3 μm, the current supply member is hardly shaved. If the current supply member is not shaved, the carbon film is not formed on the surface of the current receiver member. Therefore, it is preferable that the contact surface of the current receiver member has the surface roughness Ra of 0.3 μm or more.

Effects similar to that in the table 1 and FIG. 12 could be obtained when the current supply member was made of electrically conductive carbon material such as carbon material containing silver instead of the carbon material containing copper, and when the current receiver member was made of metal such as copper or iron instead of brass.

The heating device according to the invention is constructed based on the finding of the experiments described in the above items (A)–(E).

As described above, the current supply member 16 is made of material containing copper, carbon and molybdenum disulfide as a solid lubricant, and the contents of the copper, carbon and molybdenum disulfide are 55 wt %, 42 wt % and 3 wt %, respectively. Owing to this, the electrical contact resistance at the mutual contact surfaces of the current supply member 16 and the current receiver member 15 can be reduced, and the voltage drop at the mutual contact surfaces can be reduced. Also, the current supply member 16 can have a small specific resistance so that the voltage drop at the current supply member 16 can be reduced. Therefore, an intended voltage can be stably supplied to the resistance heating layer 12. Since the worn quantity or thickness of the current supply member 16 can be suppressed at the mutual contact surfaces, the current supply member 16 can have an increased lifetime, and therefore the heating device can have an increased lifetime.

As described above, the current receiver member 15 is made of brass, and its contact surface for contact with the current supply member 16 has the surface roughness Ra in a range from about 0.3 to about 3.0 μm. The current supply member 16 is made of carbon material containing copper, and its contact surface for contact with the current receiver member 15 has a surface roughness Ra of about 5.0 μm. Thus, the surface roughnesses of these members at their mutual contact surfaces satisfy the relationship of (surface roughness of current receiver member) ≦ (surface roughness of current supply member), the contact surface of the current supply member has the surface roughness Ra of 5.5 μm or less, and the contact surface of the current receiver member has the surface roughness Ra in a range from 0.3 μm to 3 μm. Owing to these relationship and conditions, a practical usable carbon film, which has less irregularities and a practically allowed smoothness, can be formed at the surface of the current receiver member 15 as a result of sliding between the current receiver member 15 and current supply member 16 so that the area of the contact surfaces between the current supply member 16 and the current receiver member 15 can be a sufficiently large, and the contact resistance at the mutual contact surfaces can be reduced. Therefore, an intended voltage can be stably applied to the resistance heating layer 12. Since the shaved quantity (worn quantity) of the current supply member 16 is suppressed, the lifetime of the current supply member 16 can be increased.

A carbon film may be formed, in advance, on the contact surface 152 of the current receiver member 15 for contact with the current supply member 16. A carbon film can be formed, in advance, on the surface 152 when, for example, the current receiver member 15 and the current supply member 16 are slid on each other before assembly of the heating device. Alternatively, when the current receiver member 15 is slid on a member made of a carbon material before the assembly, the carbon film can be formed, in advance, on the contact surface 152 of the current receiver member 15. After assembly of the heating device but before the actuation use thereof, the current receiver member 15 and the current supply member 16 may be slid on each other so that the carbon film can be formed on the surface 512 of the current receiver member 15. By performing the aging in this manner described above for forming, in advance, the carbon film on the current receiver member, it is possible to suppress a variation in contact resistance at the mutual contact surfaces and a variation in a sliding property during an initial use. Thereby, the heating device can be used as the heating device in the fixing device arranged in the image forming apparatus, as is done in this embodiment, in which case the contact resistance at the mutual contact surfaces can be suppressed and stable supply of the power to the resistance heating layer 12 is allowed from the start of use of the image fixing device.

Other embodiments, i.e., second, third and fourth embodiments of the heating devices according to the invention will be described below.

In any one of these heating devices, the voltage can be stably supplied to the resistance heating layer by the following structure, as can be done in the heating device shown in FIG. 1. The current supply member is made of a sintered material containing copper and carbon, and the content of the copper is in a range from 55 to 80 wt %. Preferably, the current supply member contains a solid lubricant such as molybdenum disulfide at 1 to 5 wt %. The current receiver member has the surface roughness Ra in a range from 0.3 $\mu$m to 5.5 $\mu$m, and the current supply member has the surface roughness Ra of 5.5 $\mu$m or less so that the surface roughnesses of these members at their mutual contact surfaces satisfy the relationship of (surface roughness of current receiver member) $\leqq$ (surface roughness of current supply member). A carbon film may be formed, in advance, on the contact surface of the current receiver member for contact with the current supply member by aging.

(Second Embodiment)

Figure 13:
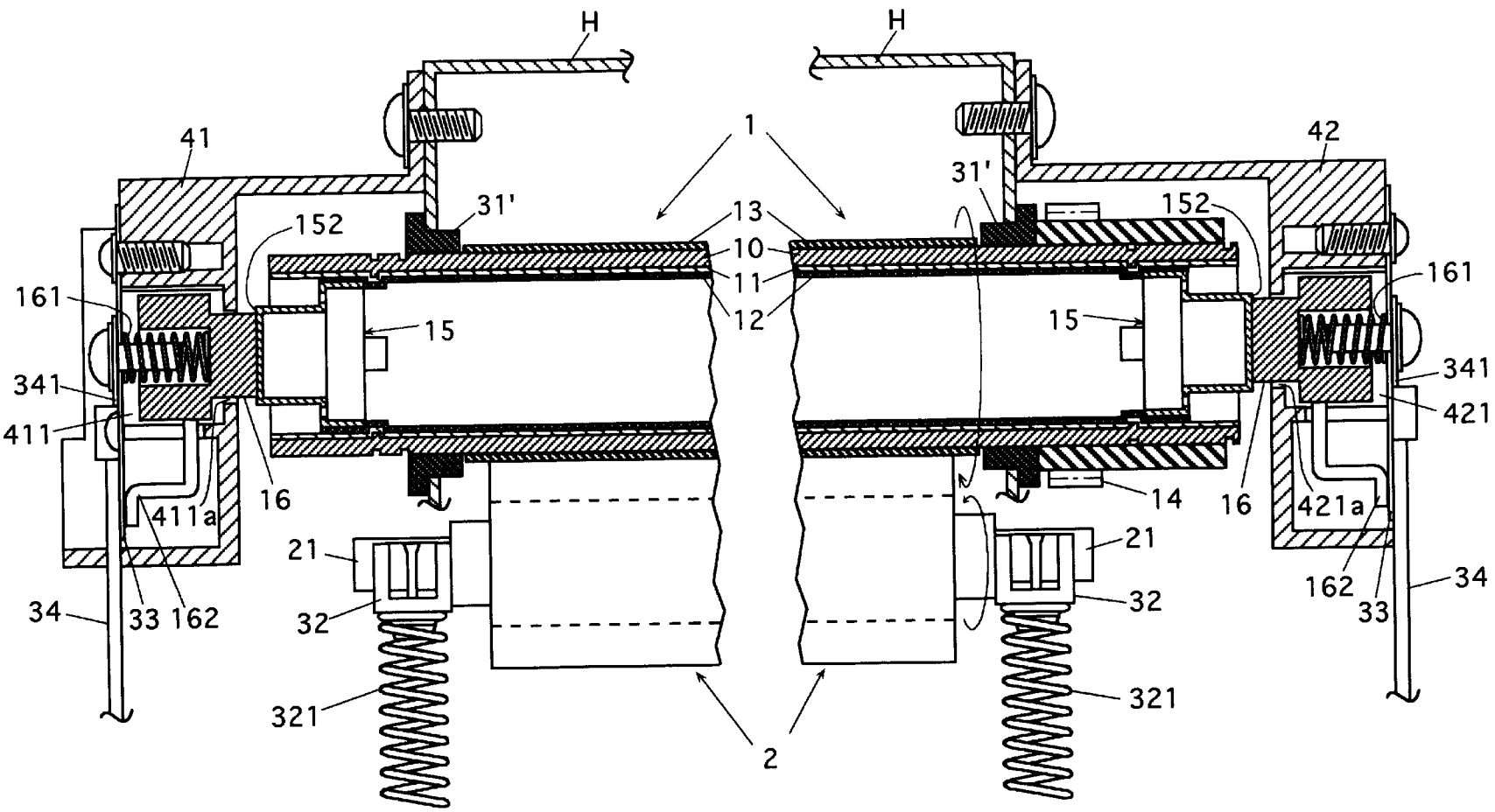
FIG. 13 is a schematic cross section of another example of the fixing device provided with the heating device according to the invention.

FIG. 13 is a schematic cross section showing another example of a heating device according to the invention. More specifically, FIG. 13 is a schematic cross section of the fixing device provided with the heating device. The fixing device and the heating device shown in FIG. 13 are substantially the same as those in FIG. 1 except for a structure for supporting the heating roller. Parts and portions having the substantially same functions bear the same reference numbers and symbols as those in FIG. 1.

This fixing device includes a heating device (heating roller device) including the heating roller 1 and others as well as the pressure roller 2 opposed to the heating roller 1. The heating roller 1 is the same as that shown in FIG. 1. The pressure roller 2 is the same as that shown in FIG. 1, and is pressed against the heating roller 1 in the same manner.

In this heating device, the heating roller 1 is rotatably carried at its opposite ends by bearings 31', which are supported by the housing H of the fixing device.

(Third Embodiment)

Figure 14:
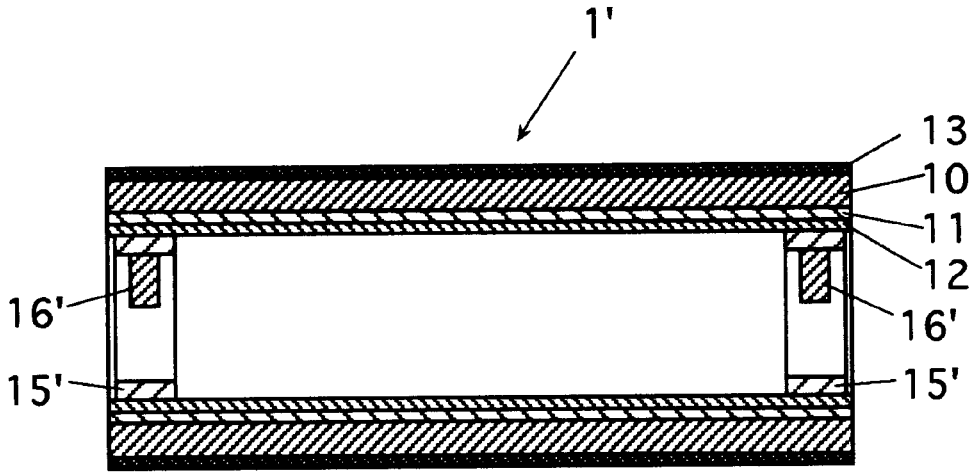
FIG. 14 is a schematic cross section of still another example of the heating device according to the invention.

FIG. 14 is a schematic cross section of still another example of a heating device according to the invention. Parts and portions having the substantially same functions as those in FIG. 1 bear the same reference numbers and symbols as those in FIG. 1.

The heating device includes a heating roller 1'.

The heating roller 1' has a hollow cylindrical core roller 10 as an endless rotary member. The inner peripheral surface of the core roller 10 is coated with the insulating layer 11 and the resistance heating layer 12 formed over the insulating layer 11. The release layer 13 is formed on the outer peripheral surface of the core roller 10. Ring-shaped current receiver members 15' are arranged at the opposite ends of the inner peripheral surface of the resistance heating layer 12, respectively.

A current supply member 16' which is pressed by an unillustrated pressing device against the inner peripheral surface of each current receiver member 15' to be contact with the current receiver member 15'.

(Fourth Embodiment)

Figure 15:
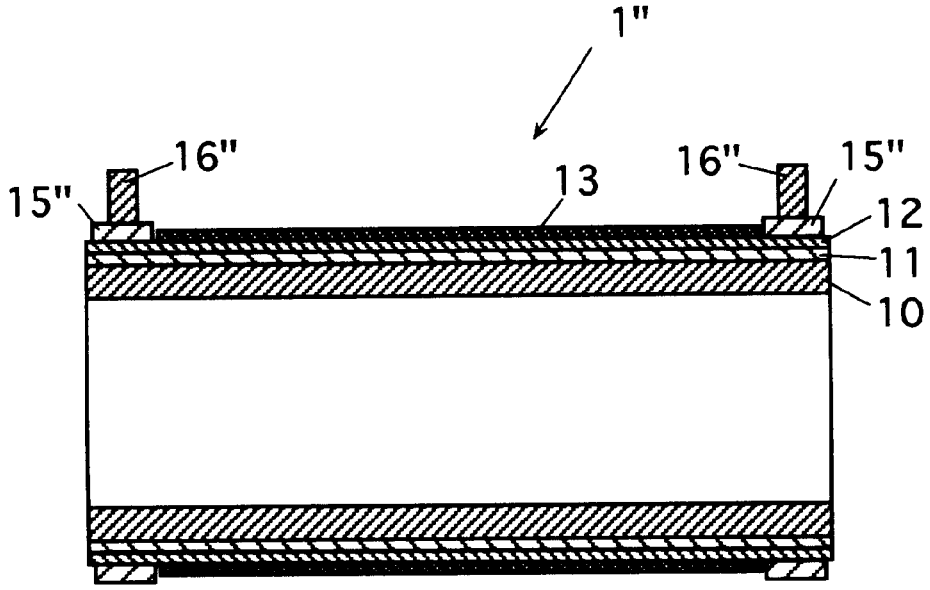
FIG. 15 is a schematic cross section of yet another example of the heating device according to the invention.

FIG. 15 is a schematic cross section of yet another example of a heating device according to the invention. Parts and portions having the substantially same functions as those in FIG. 1 bear the same reference numbers and symbols as those in FIG. 1.

The heating device includes a heating roller 1".

The heating roller 1" has a hollow cylindrical core roller 10 as an endless rotary member. The outer peripheral surface of the core roller 10 is coated with the insulating layer 11, the resistance heating layer 12 and the release layer 13 which are layered in this order. Ring-shaped current receiver members 15" are arranged at the opposite ends of the outer peripheral surface of the resistance heating layer 12, respectively.

A current supply member 16" which is pressed by an unillustrated pressing device toward the current receiver member 15" is in contact with the outer peripheral surface of each current receiver member 15".

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A heating device comprising:

an endless rotary member having a peripheral surface to be moved rotatively;

a resistance heating member arranged at the peripheral surface of said endless rotary member and generating a heat when supplied with an electric current;

a current receiver member provided at said endless rotary member and electrically connected to said resistance heating member; and a current supply member being in contact with said current receiver member and to be electrically connected to a power source, wherein a contact surface of said current receiver member for contact with said current supply member is formed of a material harder than a contact surface of said current supply member for contact with said current receiver member, the contact surface of said current receiver member for contact with said current supply member and the contact surface of said current supply member for contact with said current receiver member have surface roughnesses satisfying a relationship of (surface roughness of said current receiver member)≦(surface roughness of said current supply member), the surface roughness Ra of said current receiver member is in a range from 0.3 μm to 5.5 μm, and the surface roughness Ra of said current supply member is equal to or smaller than 5.5 μm.

2. The heating device according to claim 1, wherein said current supply member is made of an electrically conductive material containing carbon.

3. The heating device according to claim 1, wherein said current receiver member is made of an electrically conductive metal material.

4. The heating device according to claim 1, wherein said current receiver member serves also as an internal structural member of said endless rotary member.

5. The heating device according to claim 1, wherein said current receiver member takes the form of a wall partitioning an inner space of said endless rotary member, said current receiver member is exposed outward in the direction of the rotation axis of said endless rotary member, and the current supply member is in contact with said current receiver member from an outer side in the direction of the rotation axis of said endless rotary member.

6. The heating device according to claim 1, further comprising a pressing device for pressing said current supply member against said current receiver member.

7. The heating device according to claim 6, wherein said pressing device includes an elastic member for pushing said current supply member toward said current receiver member.

8. The heating device according to claim 1, wherein said endless rotary member is a hollow cylindrical roller.

* * * * *